US008326192B2

(12) United States Patent
Furuya

(10) Patent No.: US 8,326,192 B2
(45) Date of Patent: Dec. 4, 2012

(54) DEVELOPER SUPPLYING MEMBER, DEVELOPING DEVICE, AND IMAGE FORMING APPARATUS

(75) Inventor: Satoru Furuya, Tokyo (JP)

(73) Assignee: Oki Data Corporation, Tokyo (JP)

( * ) Notice: Subject to any disclaimer, the term of this patent is extended or adjusted under 35 U.S.C. 154(b) by 203 days.

(21) Appl. No.: 12/845,913

(22) Filed: Jul. 29, 2010

(65) Prior Publication Data

US 2011/0026977 A1 Feb. 3, 2011

(30) Foreign Application Priority Data

Jul. 31, 2009 (JP) ..... 2009-180088

(51) Int. Cl.
*G03G 15/08* (2006.01)

(52) U.S. Cl. ..... 399/281; 399/286

(58) Field of Classification Search ..... 399/281, 399/286, 272

See application file for complete search history.

(56) References Cited

U.S. PATENT DOCUMENTS

| | | | | |
|---|---|---|---|---|
| 2007/0286647 | A1* | 12/2007 | Sano et al. | 399/281 |
| 2007/0286648 | A1* | 12/2007 | Sano et al. | 399/281 |
| 2008/0069599 | A1* | 3/2008 | Nakamura et al. | 399/281 |

FOREIGN PATENT DOCUMENTS

| | | | |
|---|---|---|---|
| JP | 07-333996 | | 12/1995 |
| JP | 10-115977 | A | 5/1998 |
| JP | 2003-043805 | A | 2/2003 |
| JP | 2008-102181 | A | 5/2008 |
| JP | 2009-014981 | A | 1/2009 |
| JP | 2009-020198 | A | 1/2009 |
| JP | 2009-156944 | A | 7/2009 |

* cited by examiner

*Primary Examiner* — Sophia S Chen
(74) *Attorney, Agent, or Firm* — Kubotera & Associates, LLC

(57) ABSTRACT

A developer supplying member includes a foamed member formed of continuous foams for supplying developer to a developer supporting member. The foamed member has a high resistivity in terms of electrical conductivity through ion conductivity, and has a low resistivity in terms of electrical conductivity after carbon black is attached to foam cell walls thereof.

20 Claims, 7 Drawing Sheets

DEVELOPER SUPPLYING MEMBER, DEVELOPING DEVICE, AND IMAGE FORMING APPARATUS

BACKGROUND OF THE INVENTION AND RELATED ART STATEMENT

The present invention relates to a developer supplying member for supplying developer to a developer supporting member; a developing device having the developer supporting member for developing a toner image on a recording medium; and an image forming apparatus having the developing device for developing and outputting image data input thereto on the recording medium according to a specific control. Further, the present invention relates to a method of producing a developer supplying member.

In a conventional image forming apparatus such as a printer, a copier, a facsimile, an electro photography color recording apparatus, and the likes, a charging device uniformly charges a surface of an image supporting member. After an exposure device forms a static latent image on the surface of the image supporting member according to image information, a developer supplying member supplies developer as toner to a developer supporting member, so that the developer supporting member attaches developer to the image supporting member to form a toner image. After the toner image is transferred to a recording medium, a fixing device fixes the toner image, thereby forming the toner image on the recording medium.

In the conventional image forming apparatus, in order to prevent a blurred image or a reduction in a print density in the image developed on the recording medium, the developer supplying member may include a foamed layer using a foamed member formed of discrete foams (refer to Patent Reference).

Patent Reference: Japanese Patent Publication No. 07-333996

In the conventional developer supplying member including the foamed layer using the foamed member formed of the discrete foams as disclosed in Patent Reference, it is necessary to perform a foaming process and a vulcanization process using a small mold metal. Accordingly, an operation of a manufacturing machine tends to be complex, and it is difficult to increase productivity per unit time. Further, it is difficult to reduce a thickness of a foam call wall of the foamed member. Accordingly, it is difficult to decrease hardness of the foam cell wall, so that a frictional load relative to developer tends to increase, thereby easily damaging developer.

In contrast, in order to improve productivity and reduce the frictional load relative to developer, when the developer supplying member includes a foamed layer using a foamed member formed of continuous foams with low hardness, developer tends to fill in the foamed member formed of the continuous foams as the number of print sheets increases, thereby increasing a volume resistivity of the developer supplying member.

When the volume resistivity of the developer supplying member increases, an electric field intensity to be charged into a toner layer formed of developer decreases between the developer supporting member and the developer supplying member, thereby decreasing a charge amount of developer. When the charge amount of developer decreases, developer may be attached to the developer supporting member with a weaker attraction force. Accordingly, when a developing blade slides against developer to form the toner layer on a developing roller, the formation of the toner layer tends to be unstable, thereby causing a blurred text or reduction in a print density in the image data developed on the recording medium.

In view of the problems described above, an object of the present invention is to provide a developer supplying member, a developing device, and an image forming apparatus capable of solving the problems of the conventional developer supplying member. In the present invention, a volume resistivity of the developer supplying member is controlled. Accordingly, even when the number of print sheets increases, it is possible to prevent a blurred text or reduction in a print density in an image data developed on a recording medium.

Further objects and advantages of the invention will be apparent from the following description of the invention.

SUMMARY OF THE INVENTION

In order to attain the objects described above, according to the present invention, a developer supplying member includes a foamed member formed of continuous foams for supplying developer to a developer supporting member. The foamed member has a high resistivity in terms of electrical conductivity through ion conductivity, and has a low resistivity in terms of electrical conductivity after carbon black is attached to foam cell walls thereof.

In the present invention, a volume resistivity of the developer supplying member is restricted. More specifically, the developer supplying member includes the foamed member formed of the continuous foams. The foamed member has the high resistivity in terms of electrical conductivity through ion conductivity, and has a low resistivity in terms of electrical conductivity after carbon black is attached to foam cell walls thereof. Accordingly, even when the number of print sheets increases, it is possible to prevent a blurred text or reduction in a print density in an image data developed on a recording medium.

DETAILED DESCRIPTION OF PREFERRED EMBODIMENTS

Hereunder, embodiments of the present invention related to a developer supplying member, a developing device, and an image forming apparatus will be explained with reference to the accompanying drawings. The developer supplying member, the developing device, and the image forming apparatus of the present invention are not limited to the embodiments shown in the accompanying drawings, and may be modified within a scope of the present invention.

First Embodiment

In a first embodiment of the present invention, a developer supplying member includes a foamed member formed of continuous foams for supplying developer to a developer supporting member. The foamed member has a high resistivity in terms of electrical conductivity through ion conductivity, and has a low resistivity in terms of electrical conductivity after carbon black is attached to foam cell walls thereof.

Figure 1:
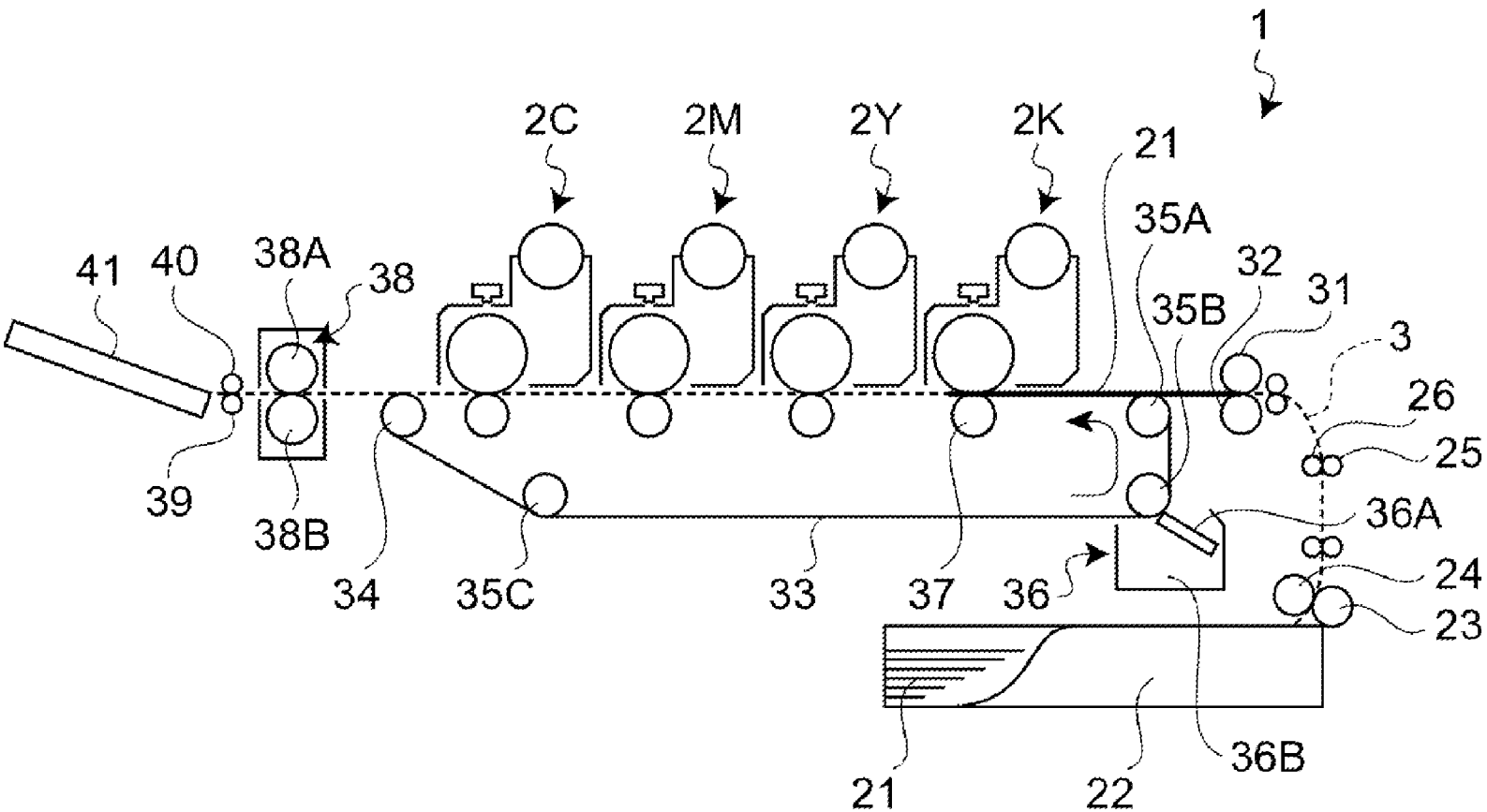
FIG. 1 is a schematic sectional view showing a configuration of an image forming apparatus according to a first embodiment of the present invention.

A configuration of an image forming apparatus 1 according to the first embodiment of the present invention will be explained with reference to FIG. 1. FIG. 1 is a schematic sectional view showing the configuration of the image forming apparatus 1 according to the first embodiment of the present invention.

As shown in FIG. 1, the image forming apparatus 1 includes developing devices 2C, 2M, 2Y, and 2K for printing on a recording medium 21 according to image information corresponding to each of cyan, magenta, yellow, and black. Further, the image forming apparatus 1 includes a sheet transportation path 3 having a substantially S character shape extending from a sheet supply cassette 22 for storing the recording medium 21 to a sheet discharge tray 41 for discharging the recording medium 21 thereon after the image information is printed on the recording medium 21.

In the embodiment, the image forming apparatus 1 includes the developing devices 2C, 2M, 2Y, and 2K for developing the image information corresponding to each of cyan, magenta, yellow, and black, and the developing devices 2C, 2M, 2Y, and 2K have a substantially identical configuration. Accordingly, the developing devices 2C, 2M, 2Y, and 2K are collectively referred to as a developing device 2 (refer to FIG. 2).

In the embodiment, the sheet transportation path 3 disposed in the image forming apparatus 1 extends from the sheet supply cassette 22 for retaining the recording medium 21 as a starting point to the sheet discharge tray 41 for discharging the recording medium 21 with the image information printed thereon as an ending point through the following components: a retard roller 23, a sheet supply roller 24, a transportation roller 25, a transportation roller 26, a pressure roller 31, a register roller 32, a transfer belt 33, a drive roller 34, idle rollers 35A, 35B, and 35C, a transfer belt cleaning unit 36, transfer rollers 37, a fixing unit 38, a discharge roller 39, and a discharge roller 40.

Figure 3:
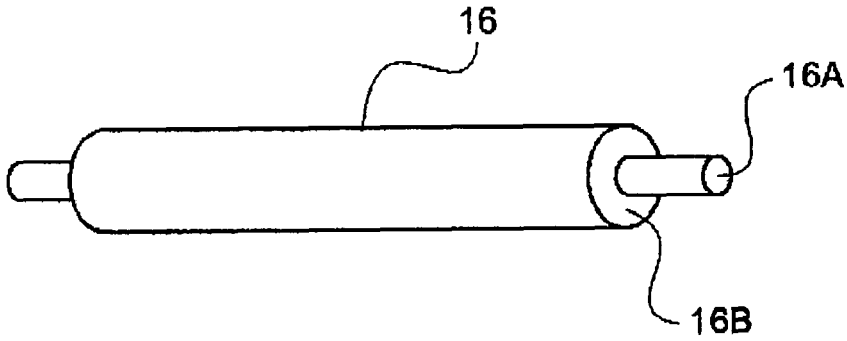
FIG. 3 is a schematic perspective view showing a toner supplying roller of the developing device according to the first embodiment of the present invention.

The components disposed along the sheet transportation path 3 will be explained in more detail with reference to FIG. 3.

In the embodiment, the recording medium 21 is a recording sheet having a specific size on which the image information in monochrome or color is developed. The recording medium 21 may include an OHP film or a paper sheet such as a recycle paper sheet, a gross paper sheet, a high-quality paper sheet. A plurality of recording media 21 is retained in the sheet supply cassette 22. When the image forming apparatus 1 starts a printing operation, the recording medium 21 is supplied from the sheet supply cassette 22 into the image forming apparatus 1.

In the embodiment, the sheet supply cassette 22 is detachably attached to the image forming apparatus 1. The retard roller 23 is pressed against the recording medium 21 retained in the sheet supply cassette 22, and rotates to pick up the recording medium 21 one by one from the sheet supply cassette 22. The sheet supply roller 24 is arranged to face the retard roller 23, so that the sheet supply roller 24 and the retard roller 23 sandwich the recording medium 21, thereby transporting the recording medium 21 to the transportation roller 25 and the transportation roller 26.

In the embodiment, the transportation roller 25 and the transportation roller 26 are arranged to face with each other, so that the transportation roller 25 and the transportation roller 26 sandwich the recording medium 21 thus transported. When the transportation roller 25 rotates, the transportation roller 26 follows the rotation of the transportation roller 25 to transport the recording medium 21 to the pressure roller 31 and the register roller 32. The pressure roller 31 and the register roller 32 are arranged to face with each other, so that the pressure roller 31 and the register roller 32 sandwich the recording medium 21. The register roller 32 is pressed against the pressure roller 31, and the pressure roller 31 rotates for removing a skew of the recording medium 21, so that the recording medium 21 is attached to the transfer belt 33.

In the embodiment, the transfer belt 33 is provided for transporting the recording medium 21 into the developing device 2, so that the image information is developed on the recording medium 21. Further, the transfer belt 33 supports the image information formed of toner 14 (refer to FIG. 2) on a circumferential surface thereof. The transfer belt 33 is formed of a belt with an endless shape, so that the recording medium 21 is attached thereto.

In the embodiment, the drive roller 34 and the idle rollers 35A, 35B, and 35C are disposed at both end portions of the transfer belt 33 formed in the endless shape, so that the drive roller 34 and the idle rollers 35A, 35B, and 35C apply specific tension to the transfer belt 33. Note that the idle rollers 35A, 35B, and 35C have a substantially same configuration. Further, the drive roller 34 and the idle rollers 35A, 35B, and 35C are formed of members having a high frictional resistance. When a drive unit (not shown) drives the drive roller 34 to rotate, the idle rollers 35A, 35B, and 35C follow the rotation of the drive roller 34 to drive and move the transfer belt 33.

In the embodiment, the transfer belt cleaning unit 36 is formed of a transfer belt cleaning blade 36A and a waste toner container 36B. The transfer belt cleaning blade 36A is arranged to abut against a surface of the transfer belt 33 with a specific pressure, so that the transfer belt cleaning blade 36A scrapes off the toner 14 and a foreign matter such as paper powder adhering to the surface of the transfer belt 33. The waste toner container 36B is provided for collecting the toner 14 and the foreign matter such as paper powder scraped off with the transfer belt cleaning blade 36A. The waste toner container 36B is disposed close to the transfer belt cleaning blade 36A below the transfer belt 33.

In the embodiment, the transfer rollers 37 are disposed below photosensitive drums 11 (described later) to be rotatable, so that the transfer rollers 37 and the photosensitive drums 11 sandwich the recording medium 21. A bias voltage with polarity opposite to that of the toner 14 is applied to the transfer rollers 37, so that the transfer rollers 37 transfer toner images formed on the photosensitive drums 11 to the recording medium 21.

In the embodiment, the fixing unit 38 is formed of a fixing roller 38A and a pressing roller 38B. The fixing roller 38A and the pressing roller 38B are arranged to face with each other, so that the fixing roller 38A and the pressing roller 38B sandwich the recording medium 21 transported with the transfer belt 33, thereby fixing the toner images developed in the developing device 2 to the recording medium 21. More specifically, a halogen lamp is disposed in the fixing roller 38A for heating and melting the toner images attached to the recording medium 21 through a weak electro static force. Then, the pressing roller 38B presses the toner images, so that the toner images are fixed to the recording medium 21. Note that the pressing roller 38B is urged to follow a rotation of the fixing roller 38A.

In the embodiment, the discharge roller 39 and the discharge roller 40 are arranged to face with each other, so that the discharge roller 39 and the discharge roller 40 sandwich the recording medium 21 transported from the fixing unit 38. When the discharge roller 39 rotates, the discharge roller 40 follows the rotation of the discharge roller 39, thereby transporting the recording medium 21 to the sheet discharge tray 41. The discharge tray 41 is provided as a storage space for placing and retaining the recording medium 21 thus discharged with the image information developed thereon.

A configuration of the developing device 2 will be explained next with reference to FIG. 2. The developing device 2 is provided for printing the toner images on the recording medium 21 according to the image information corresponding to each of cyan, magenta, yellow, and black.

Figure 2:
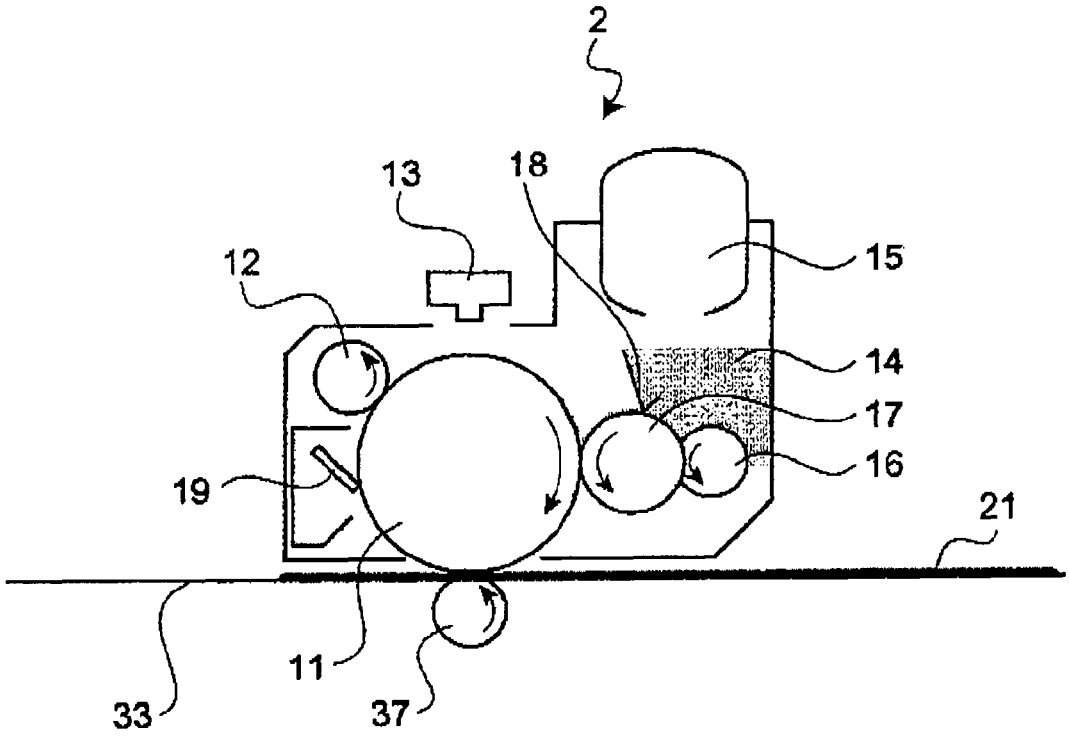
FIG. 2 is a schematic sectional view showing a configuration of a developing device of the image forming apparatus according to the first embodiment of the present invention.

FIG. 2 is a schematic sectional view showing the configuration of the developing device 2 of the image forming apparatus 1 according to the first embodiment of the present invention. For an explanation purpose, in addition to the developing device 2, FIG. 2 shows a static latent image LED (Light Emitting Diode) light source 13, the transfer belt 33, one of the transfer rollers 37, and the recording medium 21.

As shown in FIG. 2, the developing device 2 includes the photosensitive drum 11 for supporting the static latent image according to the image information; a charging roller 12 for accumulating electric charges on the surface of the photosensitive drum 11; the static latent image LED (Light Emitting Diode) light source 13 disposed on a main body of the image forming apparatus 1 for irradiating light corresponding to the image information on the surface of the photosensitive drum 11; the toner 14 as developer; a toner cartridge 15 for retaining the toner 14; a toner supplying roller 16 for supplying the toner 14 to a developing roller 17; the developing roller 17 for developing the static latent image on the surface of the photosensitive drum 11 using the toner 14; and a developing blade 18 for regulating a thickness of the toner 14 at a uniform level on a surface of the developing roller 17.

In the embodiment, the developing device 2 is detachably attached to the image forming apparatus 1. The components of the developing device 2 and the static latent image LED light source 13 disposed on the main body of the image forming apparatus 1 will be explained in more detail with reference to FIG. 2.

In the embodiment, the photosensitive drum 11 is an image supporting member for forming a developer image, and is configured to accumulate electric charges on the surface thereof for supporting the static latent image according to the image information. The photosensitive drum 11 is formed of a cylindrical shape member, and is arranged to be rotatable in a clockwise direction in FIG. 2. The photosensitive drum 11 is formed of a conductive base layer made of aluminum and the like, and a photosensitive layer made of an optical conductive layer and an electric charge transportation layer.

In the embodiment, the charging roller 12 is provided for applying specific positive electric charges or specific negative electric charges to the surface of the photosensitive drum 11 using a power source (not shown), so that electric charges are uniformly accumulated on the surface of the photosensitive drum 11. The charging roller 12 is arranged to contact with the surface of the photosensitive drum 11 with a specific pressure, and to follow the rotation of the photosensitive drum 11 to be rotatable in a counterclockwise direction in FIG. 2. The charging roller 12 is formed of a conductive metal shaft and a semi-conductive rubber such as a silicone rubber covering the conductive metal shaft.

In the embodiment, the static latent image LED light source 13 is disposed over the photosensitive drum 11 for irradiating light on the surface of the photosensitive drum 11 according to the image information, so that the static latent image is formed on the surface of the photosensitive drum 11. The static latent image LED light source 13 is formed of a combination of a plurality of LED elements and a plurality of LED drive elements. Note that the static latent image LED light source 13 is disposed on the main body of the image forming apparatus 1.

In the embodiment, the toner 14 is developer, and is attached to the static latent image formed on the surface of the photosensitive drum 11 to visualize the image information. The toner 14 has an average volume particle size of 5.5 μm, and a saturated electric charge amount of −44 μC/g. The toner 14 is produced with a negative electric charging crash method, and is formed of a polycourcedell resin.

When the saturated electric charge amount of the toner 14 was measured, 4 wt % of the toner 14 was mixed with 96 wt % of a silicone coat ferrite carrier with an average particle size of 90 μm. After the mixture was mixed in a ball mill for one minute, the saturated electric charge amount of the toner 14 was measured using an electric charge measurement device Model 1210HS (a product of Trek Corporation).

In the embodiment, the toner cartridge 15 is a container for retaining the toner 14, and is disposed above the toner supplying roller 16. The toner cartridge 15 has an elongated rectangular shape extending in a direction perpendicular to a transportation direction of the recording medium 21, and has a side surface with a substantially rectangular shape. Further, the toner cartridge 15 is detachably attached to the image forming apparatus 1, so that the toner cartridge 15 can be replaced when the toner 14 is consumed.

A configuration of the toner supplying roller 16, i.e., a critical component of the image forming apparatus 1, will be explained next in more detail with reference to FIGS. 2 and 3 and Tables 1 to 3. The toner supplying roller 16 is a developer supplying member, and is arranged to abut against a surface of the developing roller 17 to be rotatable in the counterclockwise direction in FIG. 2 for supplying the toner 14 to the developing roller 17. More specifically, the toner supplying roller 16 is arranged to abut against the developing roller 17, so that the toner supplying roller 16 is in a compressed state by about 1 mm.

In the embodiment, the toner supplying roller 16 is formed of a core metal 16A being made of stainless steel and having a diameter of 6 mm, and an elastic foamed layer 16B being disposed on an outer circumferential surface of the core metal 16A and having a cylindrical shape. Further, the toner supplying roller 16 has a diameter of 15.5 mm in a total of the core metal 16A and the elastic foamed layer 16B. The elastic foamed layer 16B is formed of a foamed member, which is foamed and cured after a polyol component, a polyisocyanate, a foaming agent, and a catalyst are mixed and stirred.

In the embodiment, the polyol component may include a polyether polyol containing a polymer polyol and a polyester polyol. The polymer polyol is a compound having a polymerized chain and a plurality of hydroxyl groups at chain ends and the likes. More specifically, the polymer polyol is formed of a polyether polyol grafted with a compound having an ethylene unsaturated bonding such as a polyacrylonitrile, stylene, and a polymethacrylonitrile. The polyisocyanate may include various polyisocyanates of an aromatic type, an aliphatic type, and a cycloaliphatic type.

In the embodiment, the aromatic type polyisocyanate may include tolylene diisocyanate (TDI), 4,4'-diphenylmethane diisocyanate (MDI), 1,5-naphthalene diisocyanate, paraphenylene diisocyanate, and m-xylene diisocyanate. The aliphatic type polyisocyanate may include 1,6-hexamethylene diisocyanate (HDI), 2,2,4-trimethylene hexamethylene diisocyanate, 2,4,4-trimethylene hexamethylene diisocyanate, and the like. The cycloaliphatic type polyisocyanate may include isophorone diisocyanate, 4,4'-dicyclohexylmethane diisocyanate, hydrogenated MDI, and the like. The polyisocyanate may be used alone or mixed with other type of polyisocyanate. The aromatic type polyisocyanate, the aliphatic type polyisocyanate, and the cycloaliphatic type polyisocyanate may be mixed or modified.

In the embodiment, the foaming agent is mainly formed of pure water, and may include methylene chloride, pentane, cyclopentane, hexane, cyclohexane, chloromethane, a chlorofluorocarbon type compound, carbon dioxide, and the like. The catalyst may also contain an amine type catalyst (in particular, a tertiary amine such as triethylene diamine, dimethylethanol amine, N,N',N'-trimethyl aminoethyl piperazine, and the like), and an organic metal compound such as octylic acid stannum (stannum octate).

In the embodiment, a foaming control agent may be used. The foaming control agent may include an organosiloxane-polyoxyalkylene copolymer, a non-ion type surfactant agent formed of a silicone compound such as a silicone-grease copolymer, a mixture thereof, an anion type surfactant agent such as dodecylbenzenesulfonic acid and potassium lauryl sulfate, a phenol type compound, and the like.

In the embodiment, the elastic foamed layer 16B may contain a conductive agent for imparting conductivity through an electron conductivity mechanism. The conductive agent includes carbon black such as furnace black, thermal black, channel black, acethylene black, ketjen black, color black, and the like; powders such as graphite; a fibrous substance; metal powders of copper, nickel, silver, and the like; a metal oxide such as tin oxide, titanium oxide, indium oxide, and the like; and organic type conductive powders made of polyacetylene, polypyrrole, polyaniline, and the like.

Further, the elastic foamed layer 16B may contain a conductive agent for imparting conductivity through an ion conductivity mechanism. The conductive agent may include a metal salt in the first group of the periodic system ($L1^+$, $Na^+$, and $K^+$) such as $LiCF_3SO_3$, $NaClO_4$, $LiClO_4$, $LiAsF_6$, $LiBF_4$, NaSCN, KSCN, and NaCl; an electrolyte such as a salt of $NH4^+$; a metal salt in the second group of the periodic system ($Ca^{++}$ and $K^+$); 1,4-butanediol, ethylene glycol, polyethylene glycol, propylene glycol, and a complex of a polyhydroxy alcohol such as polyethylene glycol and a derivative thereof; ethylene glycol monomethylether; and a complex of a mono alcohol such as ethylene glycol monomethylether and the like.

Figure 4:
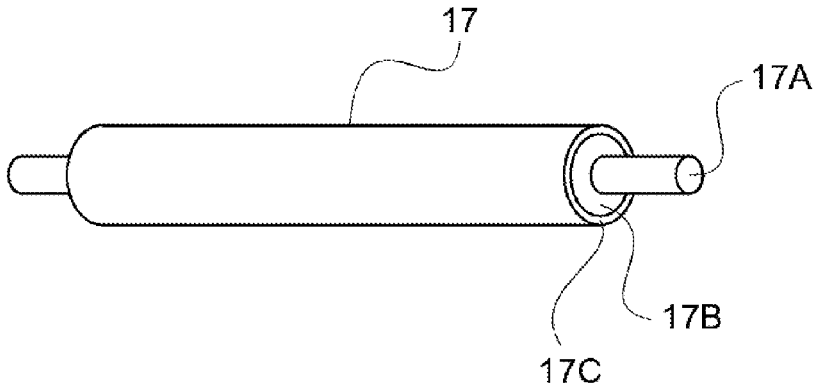
FIG. 4 is a schematic perspective view showing a developing roller of the developing device according to the first embodiment of the present invention.

A configuration of the developing roller 17 will be explained next in more detail with reference to FIGS. 2 and 4. The developing roller 17 is a developer supporting member, and is arranged to abut against the surface of the photosensitive drum 11 with a specific pressure to be rotatable in the counterclockwise direction in FIG. 2. More specifically, the developing roller 17 supplies the toner 14 to the photosensitive drum 11 while rotating, so that the static latent image formed on the surface of the photosensitive drum 11 is developed with the toner 14. Further, the developing roller 17 is arranged to abut against the photosensitive drum 11 in a state that the developing roller 17 is compressed by 0.1 mm.

In the embodiment, the developing roller 17 is formed of a core metal 17A being made of stainless steel and having a diameter of 10 mm; an elastic layer 17B being disposed on an outer circumferential surface of the core metal 17A and having a cylindrical shape; and a surface layer 17C being disposed on an outer circumferential surface of the elastic layer 17B. Further, the developing roller 17 has a diameter of 16.0 mm in a total of the core metal 17A, the elastic layer 17B, and the surface layer 17C. The core metal 17A may be coated with an adhesive or a primer to increase an adhesive property between the core metal 17A and the elastic layer 17B. In this case, the adhesive or the primer as a coating material may be formed of a conductive material.

In the embodiment, the elastic layer 17B is formed of a material such as ethylene-propylene-diene rubber (EPDM), styrene-butadiene rubber (SBR), a silicone rubber, a polyurethane type elastomer, and the like. An additive such as a conductive agent, silicone oil, and the like may be added as necessary. The conductive agent as the additive includes carbon black, graphite, potassium titanate, iron oxide, $TiO_2$, ZnO, $SnO_2$, and the like.

In the embodiment, the surface layer 17C is formed of a resin material such as an acrylic resin, an epoxy resin, a phenol resin, a polyester resin, a polyamide resin, a silicone resin, a urethane resin, and the like. An additive such as a conductive agent, a charge control agent, and the like may be added as necessary.

Further, the material of the surface layer 17C may be modified, grafted, or a process such as a block polymerization, so that the surface layer 17C is formed of a single resin material or a combination thereof. The charge control agent as the additive may include quaternary ammonium salt, borate salt, an azine type (a nigrosine type) compound, an azo compound, an oxynaphthoic acid metal complex, a surfactant agent (an anion type, a cation type, or a nonionic type), and the like. Further, the material of the surface layer 17C may contain a stabilizing agent, an ultraviolet light absorbing agent, an antistatic agent, a reinforcing material, a flow promoter, a releasing agent, a pigment, a dye, a flame retardant agent, and the like.

In the embodiment, the developing blade 18 is arranged to slightly abut against the surface of the developing roller 17 at a distal end portion thereof. The developing blade 18 is provided for scraping off the toner 14 in an excess amount supplied to the surface of the developing roller 17 from the toner supplying roller 16, so that a thickness of the toner 14 on the surface of the developing roller 17 is constantly maintained at a uniform level. The developing blade 18 is formed of an elastic plate member made of a material such as stainless steel. The elastic plate member of the developing blade 18 has a thickness of 0.08 mm, and has a contact portion abutting against the developing roller 17 in a curved shape. The curved shape has a curvature radius of 0.5 mm, and a surface roughness of 0.6 μm measured with a ten-point average surface roughness measurement method.

In the embodiment, a cleaning blade 19 is provided for scraping off the toner 14 remaining on the photosensitive drum 11 after the toner image formed on the photosensitive drum 11 is transferred to the recording medium 21. More specifically, the cleaning blade 19 is formed in a plate shape, and is disposed on an upstream side of the charging roller 12 in a rotational direction of the photosensitive drum 11 to abut against the surface of the photosensitive drum 11 with a specific pressure. Further, the toner 14 scraped off from the photosensitive drum 11 with the cleaning blade 19 is transported with a cleaning spiral having a screw shape (not shown) to a waste toner collection container (not shown).

An experiment for evaluating the toner supplying roller 16 will be explained next. In the experiment for evaluating the toner supplying roller 16, five rollers A, B, C, D, and E were produced under different conditions. Further, rollers C1 and C2 having only different sizes from that of the roller C were produced. Tables 1 to 3 show configurations of the rollers A, B, C, D, and E, and results of evaluations.

TABLE 1

| | Roller A | Roller B | Roller C | Roller D | Roller E |
|---|---|---|---|---|---|
| Composition | | | | | |
| Polyol 1 | 50 | 50 | 50 | 50 | 50 |
| Polyol 2 | 50 | 50 | 50 | 50 | 50 |
| Isocyanate | 1130 | 110 | 110 | 110 | 11.0 |
| Foaming agent (pure water) | 1.7 | 1.7 | 1.7 | 1.7 | 1.7 |
| Catalyst 1 | 0.3 | 0.3 | 0.3 | 0.3 | 0.3 |
| Catalyst 2 | 0.2 | 0.2 | 0.2 | 0.2 | 0.2 |
| Foaming control agent | 1.0 | 1.0 | 1.0 | 1.0 | 1.0 |
| Ion conductive agent | — | 0.1 | 2.0 | 4.0 | 6.0 |
| Volume resistivity ρ $10^{\rho}$ (Ω · cm) at 10 V | 12.3 (at 500 V) | 11.9 | 10.5 | 10.1 | 9.3 |
| Fixing process | | | | | |
| Fixing agent | Acrylic type emulsion | Acrylic type emulsion | Acrylic type emulsion | Acrylic type emulsion | Acrylic type emulsion |
| Conductive agent | Carbon aqueous dispersion | Carbon aqueous dispersion | Carbon aqueous dispersion | Carbon aqueous dispersion | Carbon aqueous dispersion |
| Volume resistivity ρ after fixing process $10^{\rho}$ (Ω · cm) at 10 V | 6.2 | 5.9 | 4.9 | 4.7 | 4.6 |
| Outer diameter (mm) | 15.5 | 15.5 | 15.5 | 15.5 | 15.5 |
| Blurred text after 10K sheets | Poor | Good | Good | Good | Good |
| Generated current (μA) | 1.06 | 32.6 | 33.7 | 48.3 | — |
| Bleed | Good | Good | Good | Good | Poor |
| Torque (kgf · cm) | 0.51 | 0.50 | 0.49 | 0.49 | 0.43 |

TABLE 2

| | Roller C | Roller C1 | Roller C2 |
|---|---|---|---|
| Outer diameter (mm) | 15.5 | 14.7 | 14.5 |

TABLE 2-continued

| | Roller C | Roller C1 | Roller C2 |
|---|---|---|---|
| Torque (kgf · cm) | 0.49 | 0.35 | 0.21 |
| Toner scraping off capability (ghost image evaluation) | Good | Good | Poor |

TABLE 3

| | Material | Manufacture | Product name |
|---|---|---|---|
| Polyol 1 | Polyether polyol | Sanyo Chemical Industries, Ltd. | GP-3050 |
| Polyol 2 | Acrylonitrile-stylene graft polymer polyol | Asahi Glass Co., Ltd. | Excenol 941 |
| Isocyanate | Tolylene diisocyanate | Mitsui Takeda Chemicals, Inc. | TDI-80 |
| Catalyst 1 | Amine catalyst | Kao Corporation | Kaolyzer No. 31 |
| Catalyst 2 | Amine catalyst | | Kaolyzer No. 22 |
| Foaming control agent | Silicone type surfactant agent | Goldschmidt Co., Ltd. | B8110 |

Figure 12:
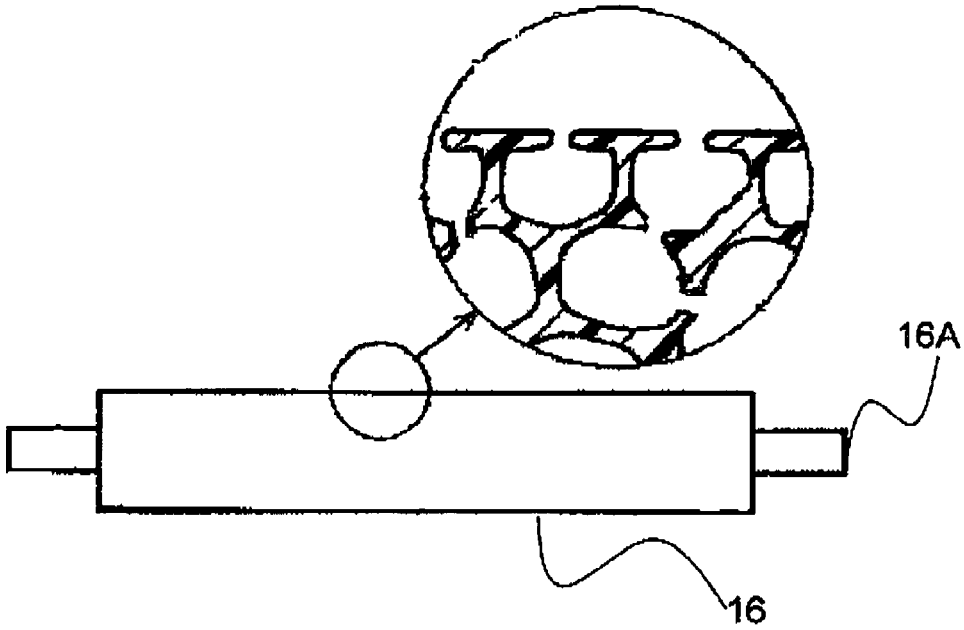
FIG. 12 is a schematic view showing the toner supplying roller of the developing device including an enlarged view of continuous foam cells thereof according to the first embodiment of the present invention

A manufacturing process of the roller A will be explained next in more detail. First, as shown in Tables 1 and 3, a polyol, an isocyanate, a forming agent, a catalyst, and a foaming control agent were mixed and poured in a square container having a side length of 500 mm. Without placing a lid on the square container, the mixture was foamed under atmospheric pressure. Then, the square container was passed through a heating oven to heat the mixture, so that the mixture was reacted and cured, thereby obtaining a foamed member having continuous foam cells as shown in FIG. 12. Note that, in order to produce the foamed member having the continuous foam cells, it is necessary to foam the mixture under atmospheric pressure. It was preferred that the square container has a side length greater than 300 mm.

After the foamed member having the continuous foam cells was produced, the foamed member was cut into a rectangular member having a side of 400 mm and a height of 25 mm, and then the rectangular member was immersed in a conductive processing solution at 20° C. for five minutes. As described above, the foamed member had the continuous foam cells, that is, each of the foam cells was connected to each other. Accordingly, it was possible to easily immerse the conductive processing solution into the foamed member. In preparing the conductive processing solution, a carbon black dispersion solution having a solid content of 36% (Ecomal black, a product of SANYO COLOR WORKS, Ltd.) as the conductive agent was added in an acrylic resin emulsion having a solid contact of 45% (Nipol 1851, a product of ZEON CORPORATION) as a fixing agent at a ratio of 30 wt %, and a mixture was stirred.

In the next step in producing the roller A, after the rectangular member with the height of 25 mm was immersed in the conductive processing solution at 20° C. for five minutes, the rectangular member was passes through a pair of tool rolls arranged with an interval of 0.2 mm, thereby squeezing out an excess amount of the conductive processing solution. In Table 3, "TDI-80" represents a mixture of 80 mass % of 2,4-tolylene diisocyanate and 20 mass % of 2,6-tolylene diisocyanate.

In the next step in producing the roller A, after an excess amount of the conductive processing solution is squeezed out with the tool rollers, the rectangular member was heated and dried in a hot air circulation oven at 100° C. for 60 minutes. Through the heating and drying process, moisture was removed from the rectangular member of the foamed member, and the acrylic resin was cross-linked, so that carbon black was strongly adhered to walls of the continuous foam cells, thereby producing a conductive foamed member to be used for the elastic foamed layer 16B.

In the next step in producing the roller A, the rectangular member having the side of 400 mm and the height of 25 mm was cut into a rectangular column member having a length of 300 mm and a square side surface with one side of 25 mm. Then, a through hole with a diameter of 5 mm was formed at a center of the square side surface with one side of 25 mm, so that the core metal 16A passed through the through hole.

In the next step in producing the roller A, an adhesive was coated on a surface of the core metal 16A, which was formed of a metal shaft made of stainless steel and had a diameter of 6 mm and a length of 272 mm. Then, the core metal 16A passed through the through hole with the diameter of 5 mm of the elastic foamed layer 16B, i.e., the rectangular column member having the length of 300 mm and the square side surface with one side of 25 mm. Lastly, the elastic foamed layer 16B was polished, so that an outer diameter of the elastic foamed layer 16B became 15.5 mm, thereby producing the roller A through the process described above.

In Table 1, a volume resistivity ρ is represented in a format of $10^{\rho}$ (Ω·cm) in a case that a voltage of 10 V was applied. In a case of the roller A, due to an extremely high resistivity, a voltage of 500 V was applied, so that a resistivity did not exceed a dynamic range of a measurement device.

A manufacturing process of the rollers B, C, D, and E will be explained next in more detail. It is characterized that each of the rollers B, C, D, and E contained an ion conductive agent. Other components of the rollers B, C, D, and E were the same as those of the roller A. Accordingly, the rollers B, C, D, and E were produced using the polyol, the isocyanate, the forming agent, the catalyst, and the foaming control agent the same as those of the roller A.

In producing the rollers B, C, D, and E, lithium perchlorate unhydrate (a product of KANTO CHEMICAL CO., INC.) was used as the ion conductive agent. More specifically, the roller B contained a least amount of the ion conductive agent, and the roller E contained a largest amount of the ion conductive agent.

When the roller C was produced, after the conductive foamed member was formed similar to the roller A, the core metal 16A, formed of the metal shaft made of stainless steel and having a diameter of 6 mm and a length of 272 mm, passed through the through hole. Lastly, the elastic foamed layer 16B was polished, so that the outer diameter of the elastic foamed layer 16B became 15.5 mm, thereby producing the roller C. Further, as shown in Table 2, the elastic foamed layer 16B was polished, so that the outer diameters of the elastic foamed layer 16B became 14.7 mm and 14.5 mm, thereby producing the rollers C1 and C2. Accordingly, only the outer diameters of the rollers C1 and C2 were different from that of the roller C.

In the experiment, an electrical resistivity property and print quality of the toner supplying roller 16 were evaluated. First, a method of measuring the electrical resistivity property of the toner supplying roller 16 will be explained with reference to FIG. 5. Next, a method of measuring a volume resistivity of the toner supplying roller 16 will be explained with reference to FIGS. 6 and 7.

Figure 5:
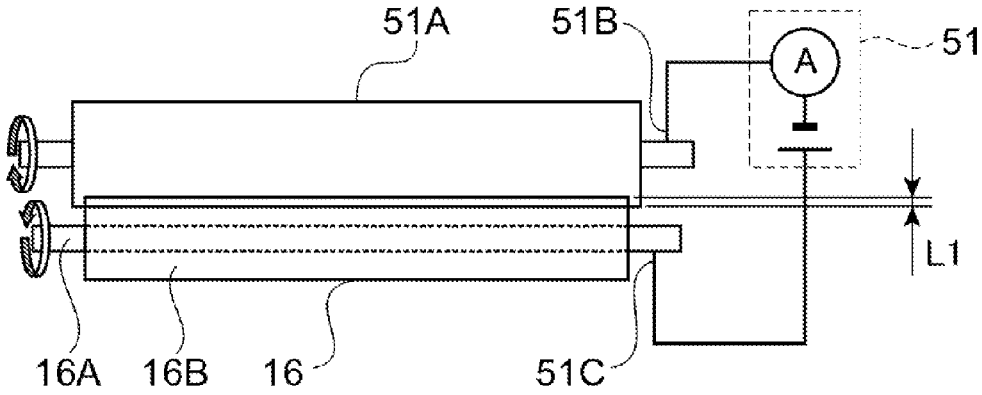
FIG. 5 is a schematic view showing a method of measuring an electrical resistivity of the toner supplying roller according to the first embodiment of the present invention.

Note that it is possible to determine whether a blurred text may occur according to the electrical resistivity. FIG. 5 is a schematic view showing a method of measuring the electrical resistivity of the toner supplying roller 16 according to the first embodiment of the present invention.

As shown in FIG. 5, an electrical resistivity measurement device 51 was used to measure the electrical resistivity of the toner supplying roller 16. More specifically, a high resistance meter 4339A (a product of Hewlett-Packard Company) was used as the electrical resistivity measurement device 51.

When the electrical resistivity of the toner supplying roller 16 was measured, first, a test lead 51B of the electrical resistivity measurement device 51 was connected to a metal roller tool 51A being made of stainless steel and having an outer diameter of 30 mm, and a test lead 51C was connected to the core metal 16A of the toner supplying roller 16. Then, the metal roller tool 51A was arranged to abut against the outer circumferential surface of the elastic foamed layer 16B of the toner supplying roller 16.

As described above, the toner supplying roller 16 is arranged to abut against the developing roller 17, so that the toner supplying roller 16 is in a compressed state by about 1 mm. Accordingly, in order to reproduce the same arrangement, the metal roller tool 51A was arranged to abut against the outer circumferential surface of the elastic foamed layer 16B of the toner supplying roller 16, so that the elastic foamed layer 16B of the toner supplying roller 16 was in a compressed state by about a distance L1 (=1 mm). In the next step, the metal roller tool 51A was rotated at a rotation of 62.5 rpm, so that the toner supplying roller 16 rotates following the rotation of the metal roller tool 51A. Then, a voltage was applied between the metal roller tool 51A and the core metal 16A, and a generated current was measured.

As described above, it is possible to determine whether a blurred text may occur through measuring the electrical resistivity when the image forming apparatus 1 is operated and the image data are developed on the recording medium 21. More specifically, it is known that the electrical resistivity of the toner supplying roller 16 is expressed in a non-linear function with an applied voltage as a parameter. Accordingly, when various voltages are applied and generated currents are measured, it is possible to obtain a non-linear property of the electrical resistivity of the toner supplying roller 16.

In an actual case, when an applied voltage was less than 100 V and a generated current was less than 10 A, a blurred text did not occur in the image data developed on the recording medium 21, so that the generated current can be considered as an optimal condition. When the optical condition is not met, the toner 14 is charged with only a small amount due to a weak electrical field generated between the developing roller 17 and the toner supplying roller 16 to be poured into the toner layer formed of the toner 14. When the toner 14 is charged with only a small amount, the toner 14 tends to be repelled with the developing blade 18. Accordingly, it is difficult to stably form the toner layer on the developing roller 17, thereby causing a blurred text in the image data developed on the recording medium 21.

Figure 6:
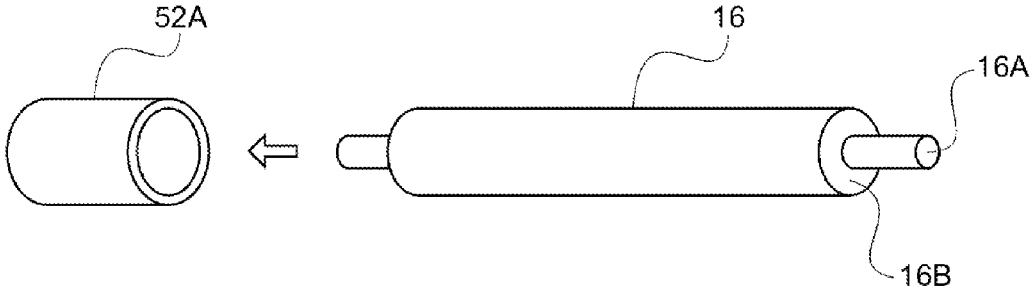
FIG. 6 is a schematic view showing a method of measuring a volume resistivity of the toner supplying roller according to the first embodiment of the present invention.
Figure 7:
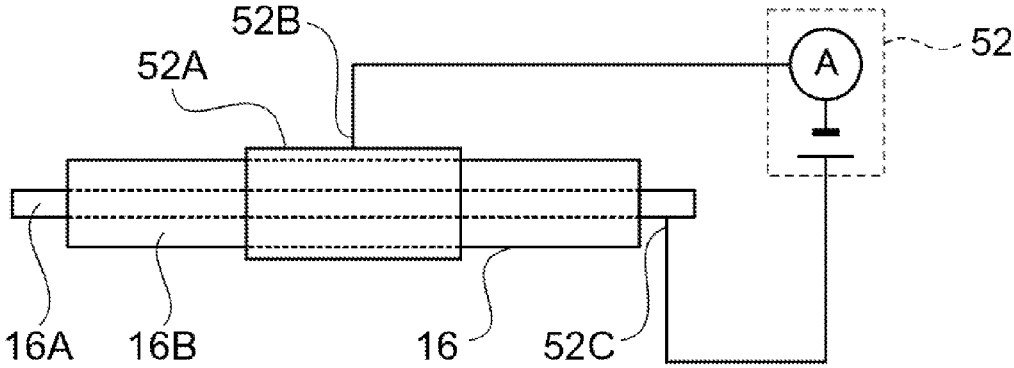
FIG. 7 is another schematic view showing the method of measuring the volume resistivity of the toner supplying roller according to the first embodiment of the present invention.

A method of measuring the volume resistivity of the toner supplying roller 16 will be explained next with reference to FIGS. 6 and 7. FIG. 6 is a schematic view showing the method of measuring the volume resistivity of the toner supplying roller 16 according to the first embodiment of the present invention. FIG. 7 is another schematic view showing the method of measuring the volume resistivity of the toner supplying roller 16 according to the first embodiment of the present invention.

As shown in FIG. 7, an electrical resistivity measurement device 52 was used to measure the volume resistivity of the toner supplying roller 16. More specifically, an ultrahigh resistance meter 8340A (a product of ADC CORPORATION) was used as the electrical resistivity measurement device 52.

When the volume resistivity of the toner supplying roller 16 was measured, first, a test lead 52B of the electrical resistivity measurement device 52 was connected to a metal cylindrical tool 52A made of stainless steel and formed in a cylindrical shape with an outer diameter of 15.5 mm, and a test lead 52C was connected to the core metal 16A of the toner supplying roller 16. Then, the metal cylindrical tool 52A was inserted into the toner supplying roller 16. In this case, an inner portion of the metal cylindrical tool 52A had an inner diameter and a surface roughness optimized such that the surface of the elastic foamed layer 16B of the toner supplying roller 16 closely contacted with the inner portion. Then, a voltage was applied between the metal cylindrical tool 52A and the core metal 16A, and the volume resistivity was calculated from a generated current in consideration of the shapes of the metal cylindrical tool 52A and the toner supplying roller 16.

In the experiment, a toner scraping off capability of the developing roller 17 was evaluated. With related to the evaluation, a method of measuring a load torque between the developing roller 17 and the toner supplying roller 16 will be explained with reference to FIG. 8. Further, a method of evaluating a ghost image will be explained with reference to FIGS. 9(*a*) and 9(*b*).

Figure 8:
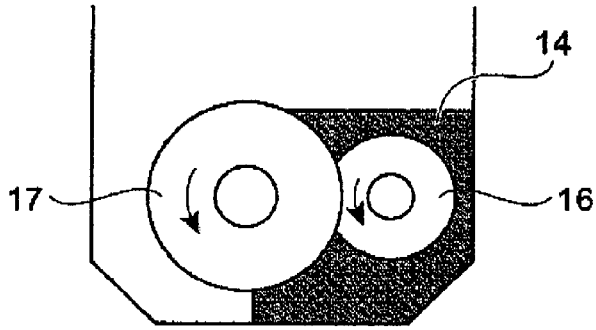
FIG. 8 is a schematic view showing a method of measuring a load torque in terms of a toner scraping off capability of the developing roller between the developing roller and the toner supplying roller according to the first embodiment of the present invention.

FIG. 8 is a schematic view showing the method of measuring the load torque in terms of the toner scraping off capability of the developing roller 17 between the developing roller 17 and the toner supplying roller 16 according to the first embodiment of the present invention. When the load torque between the developing roller 17 and the toner supplying roller 16 was measured, the developing device 2 was constituted of only the developing roller 17 and the toner supplying roller 16, so that a sufficient amount of the toner 14 was situated between the developing roller 17 and the toner supplying roller 16.

In measuring the load torque between the developing roller 17 and the toner supplying roller 16, the developing roller 17 and the toner supplying roller 16 had the outer diameters described above. Further, the developing roller 17 and the toner supplying roller 16 were arranged such that a distance between centers of the core metals of the developing roller 17 and the toner supplying roller 16 was 14.75 mm, i.e., the same arrangement as that in a preferred embodiment.

Further, the developing roller 17 and the toner supplying roller 16 were arranged to rotate at specific rotational speeds such that a difference in circumferential speeds thereof became a specific level, i.e., the same arrangement as that in the preferred embodiment. More specifically, the developing roller 17 and the toner supplying roller 16 were arranged to rotate in a same direction at rotational speeds of 233 rpm and 159 rpm, respectively. Under the conditions described above, a frictional load (kgf·cm) between the developing roller 17 and the toner supplying roller 16 was defined as the load torque.

Figure 9A:
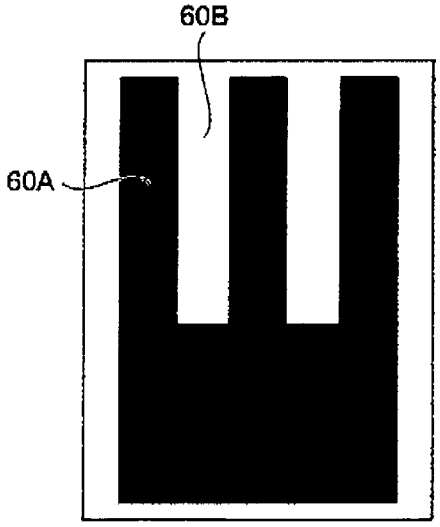
FIGS. 9(*a*) and 9(*b*) are schematic views showing image evaluation patterns with respect to the toner scraping off capability of the developing roller according to the first embodiment of the present invention, wherein FIG. 9(*a*) is a schematic view showing a standard image evaluation pattern, and FIG. 9(*b*) is a schematic view showing a ghost image evaluation pattern.
Figure 9B:
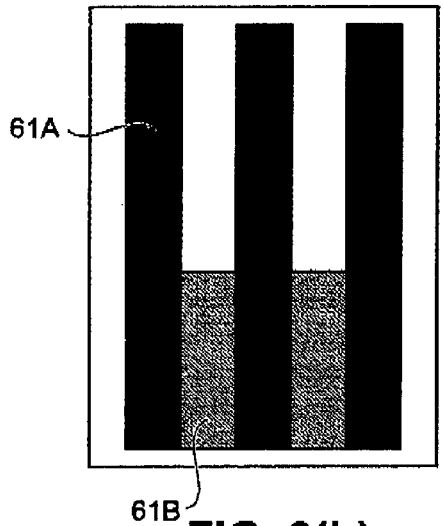

The ghost image was evaluated using image evaluation patterns shown in FIGS. 9(*a*) and 9(*b*). FIGS. 9(*a*) and 9(*b*) are schematic views showing the image evaluation patterns with respect to the toner scraping out capability of the developing roller 17 according to the first embodiment of the present invention.

More specifically, FIG. 9(*a*) is a schematic view showing a standard image evaluation pattern. As shown in FIG. 9(*a*), the standard image evaluation pattern is formed of a 100% density portion 60A printed with a toner density of 100% and a 0% density portion 60B printed with a toner density of 0%. FIG. 9(*b*) is a schematic view showing a ghost image evaluation pattern. As shown in FIG. 9(*b*), the ghost image evaluation pattern is formed of a density measurement portion 61A and a density measurement portion 61B.

In evaluating the ghost image, the toner densities of the density measurement portion 61A and the density measurement portion 61B were measured with a spectrum density meter X-Rite 528 (a product of X-Rite). When a difference in the toner densities between the density measurement portion 61A and the density measurement portion 61B was less than 5%, the result was represented as good. When the difference in the toner densities between the density measurement portion 61A and the density measurement portion 61B was greater than 5%, the result was represented as poor. Note that when the toner scraping out capability of the developing roller 17 is poor, the difference in the toner densities between the density measurement portion 61A and the density measurement portion 61B becomes greater.

Figure 10:
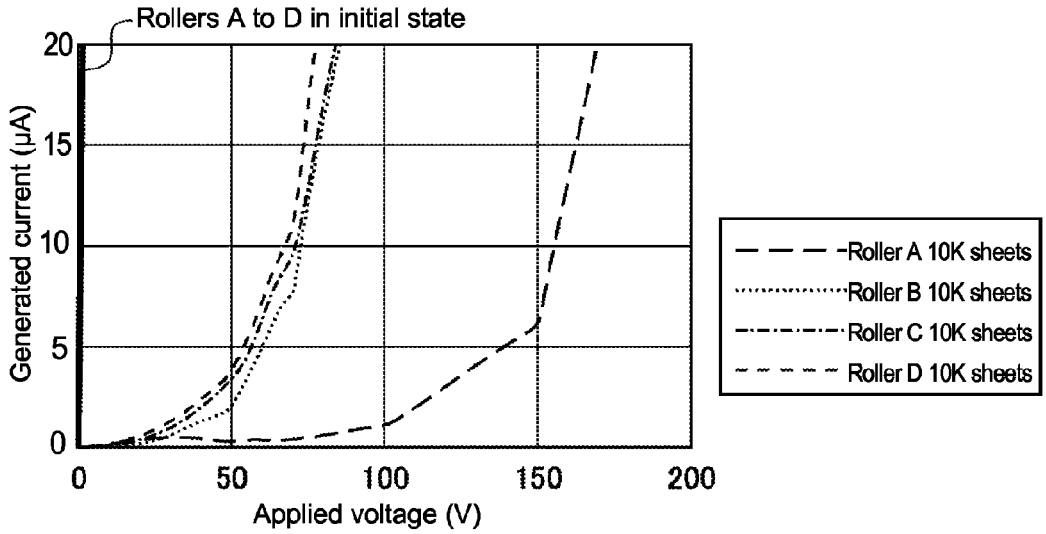
FIG. 10 is a graph showing a relationship between an applied voltage and a generated current associated with the electrical resistivity of the toner supplying roller according to the first embodiment of the present invention.

A relationship between the print quality and the electrical resistivity property of the toner supplying roller 16 according to the electrical resistivity and the volume resistivity of the toner supplying roller 16 will be explained with reference to FIG. 10, Table 1 and Table 2. Table 1 shows the volume resistivity and the evaluation results of the rollers A to E produced as the toner supplying roller 16 with the different configurations. FIG. 10 is a graph showing a relationship between the applied voltage and the generated current associated with the electrical resistivity of the rollers A to E according to the first embodiment of the present invention.

In the experiment of evaluating the rollers A to E produced as the toner supplying roller 16 with the different configurations, an optical LES type color electro-photography printer MICROLINE 5900dn (a product of OKI DATA CORPORATION) having a resolution of 600 DPI was used. The toner 14 had a volume average particle size of 5.5 μm, and a saturated charge amount of −44 μC/g. Further, the toner 14 was formed of a non-magnetic one component with a negatively charging crash manufacturing method using a polyester resin. Further, the image forming apparatus 1 performed the printing operation under an environment with a room temperature of 23° C. and relative humidity of 45% RH.

In order to evaluate the blurred text, after a text pattern with an image area density of 100% density was printed on the recording medium 21, a developed image was evaluated. More specifically, an image density difference between an upper edge and a lower edge of the recording medium 21 was measured with the spectrum density meter X-Rite 528 (the product of X-Rite). When the image density difference was less than five, the result shown in Table 1 was represented as good. When the image density difference was equal to or greater than five, the result shown in Table 1 was represented as poor. Note that, in Table 1, K represents one thousand.

The evaluation results of the rollers A to E will be explained next. As compared to the rollers B to E, the roller A had the volume resistivity ρ of the foamed member at a very high level, i.e., $10^{12.3}$ Ω·cm, before the carbon fixing process, and the blurred text occurred at an accumulated printed sheets of 10,000.

As shown in FIG. 10, the roller A showed the generated current at a low level of 1.06 μA at the applied voltage of 100V and the accumulated printed sheets of 10,000. Accordingly, a weak electrical field was generated between the developing roller 17 and the toner supplying roller 16 to be poured into the toner layer formed of the toner 14. When the toner 14 was charged with only a small amount, a mirror image force relative to the developing roller 17 became weak and the toner 14 tended to be repelled with the developing blade 18, thereby causing the blurred text.

With respect to the rollers B to D, the blurred text did not occur at the accumulated printed sheets of 10,000. Further, at the accumulated printed sheets of 10,000, the toner 14 was squeezed and filled in the elastic foamed layer 16B of the toner supplying roller 16. In this state, as shown in Table 1, the rollers B to D showed the generated currents of 32.6 μA, 33.7 μA, and 48.3 μA, respectively. When the generated current was greater than 10.0 μA at the applied voltage of less than 100 V, the blurred text did not occur.

In the experiment, as described above, the roller A had the volume resistivity ρ of the foamed member at the very high level, i.e., $10^{12.3}$ Ω·cm, before the carbon fixing process. Further, the rollers B to D had the volume resistivity ρ of the foamed member at the same value, i.e., in a range of $10^{10.1}$ to $10^{11.9}$ Ω·cm, before the carbon fixing process. Accordingly, when the ion conductive agent was not added such as in the case of the roller A, it was possible to realize only the low conductivity. On the other hand, when the ion conductive agent was added such as in the case of the rollers B to D, it was possible to realize the high conductivity. In this case, the conductive path was not limited to the foam cell walls of the core metal 16A, where the carbon fixing agent was adhered, but included in the resin portion of the foamed member. Accordingly, the electron conductive mechanism involved in the carbon fixing process and the ion conductive mechanism in the urethane backbones were mutually contributed to the volume resistivity.

In the experiment, with respect to the roller E, the toner 14 adhered to the surface of the developing roller 17 during the endurance test of the accumulated sheets of 10,000, thereby causing a drum filming. The roller E contained the relatively large amount of the ion conductive agent at 6.0 wt %. Accordingly, the ion conductive agent overflowed from the core metal 16A, thereby causing the drum filming. Further, when the ion conductive agent overflowed from the core metal 16A, the ion conductive agent was mixed with the toner 14, so that a color of the image developed on the recording medium 21 was changed, thereby causing a bleed phenomenon.

Note that FIG. 10 does not show the measurement data of the roller E. Further, the rollers B and C and the roller C1 showed the good toner scraping off property using the ghost image evaluation method. On the other hand, the roller C2 showed the poor toner scraping off property using the ghost image evaluation method. This was attributed to the fact that the roller C2 showed the low torque of 0.21 kgf·cm as compared with the other rollers.

As described above, in the embodiment, the toner supplying roller 16 is formed of the foamed member with the continuous foam cells have the high electrical resistivity of the electrical conductivity due to the ion conductivity. Further, after carbon black is fixed to the foam cell walls, the toner supplying roller 16 has the low resistivity of the electrical conductivity. Accordingly, when the image forming apparatus 1 prints a large number of print sheets, it is possible to prevent the blurred text and the lowered text density of the image developed on the recording medium 21.

Second Embodiment

A second embodiment of the present invention will be explained next. In the second embodiment, the developer supply member is formed of a foamed member having continuous foam cells for supplying developer to the developer supporting member. The foamed member has a high resistivity of the electrical conductivity through electron conductivity. Further, after carbon black is fixed to the foam cell walls thereof, the foamed member has a low resistivity of the electrical conductivity.

A configuration of the toner supplying roller 16 in the second embodiment of the present invention will be explained next. In the second embodiment, carbon black, instead of the ion conductive agent, is added to the core metal 16A of the toner supplying roller 16. Other configuration or the manufacturing process of the toner supplying roller 16 is similar to that of the toner supplying roller 16 in the first embodiment. Accordingly, a redundant explanation is omitted for the sake of simple explanation, and only the feature of adding carbon black to the elastic foamed layer 16B of the toner supplying roller 16 will be explained.

Figure 11:
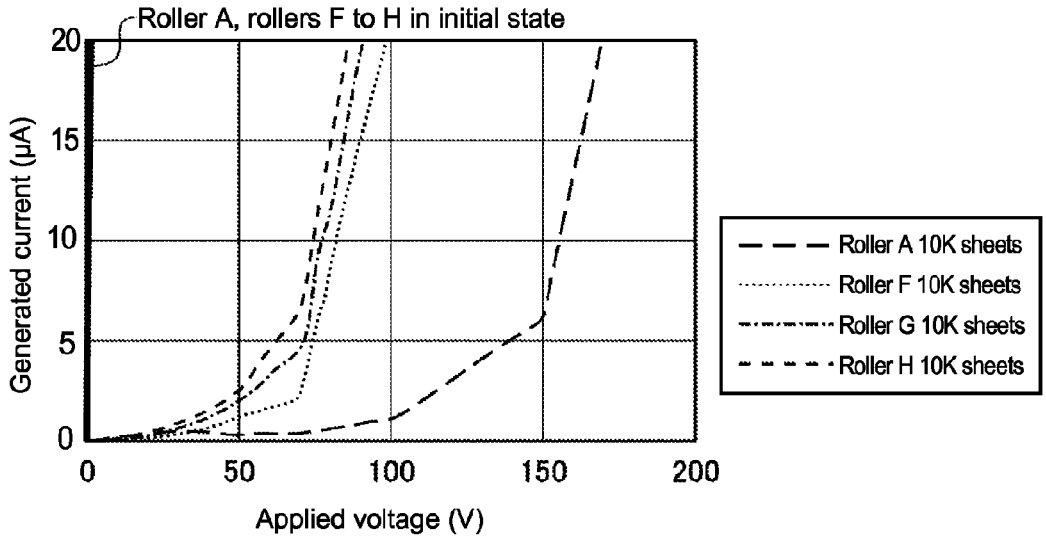
FIG. 11 is a graph showing a relationship between an applied voltage and a generated current associated with an electrical resistivity of a toner supplying roller according to a second embodiment of the present invention.

A relationship between the print quality and the electrical resistivity property of the toner supplying roller 16 according to the electrical resistivity and the volume resistivity of the toner supplying roller 16 will be explained with reference to FIG. 11, Table 4 and Table 5. Table 4 and Table 5 show the volume resistivity and the evaluation results of rollers F to I produced as the toner supplying roller 16 with different configurations. FIG. 11 is a graph showing a relationship between an applied voltage and a generated current associated with the electrical resistivity of the toner supplying roller 16 according to the second embodiment of the present invention.

TABLE 4

| | Roller F | Roller G | Roller H | Roller I |
|---|---|---|---|---|
| Composition | | | | |
| Polyol 1 | 50 | 50 | 50 | 50 |
| Polyol 2 | 50 | 50 | 50 | 50 |
| Isocyanate | 110 | 110 | 110 | 11.0 |

TABLE 4-continued

| | Roller F | Roller G | Roller H | Roller I |
|---|---|---|---|---|
| Foaming agent (pure water) | 1.7 | 1.7 | 1.7 | 1.7 |
| Catalyst 1 | 0.3 | 0.3 | 0.3 | 0.3 |
| Catalyst 2 | 0.2 | 0.2 | 0.2 | 0.2 |
| Foaming control agent | 1.0 | 1.0 | 1.0 | 1.0 |
| Carbon black | 0.1 | 2.0 | 5.0 | 8.0 |
| Volume resistivity ρ $10^{\rho}$ (Ω · cm) at 10 V | 12.1 (at 500 V) | 11.4 | 9.1 | 9.3 |
| Fixing process | | | | |
| Fixing agent | Acrylic type emulsion | Acrylic type emulsion | Acrylic type emulsion | Acrylic type emulsion |
| Conductive agent | Carbon aqueous dispersion | Carbon aqueous dispersion | Carbon aqueous dispersion | Carbon aqueous dispersion |
| Volume resistivity ρ after fixing process $10^{\rho}$ (Ω · cm) at 10 V | 6.1 | 5.1 | 4.9 | 4.6 |
| Outer diameter (mm) | 15.5 | 15.5 | 15.5 | 15.5 |
| Blurred text after 10K sheets | Good | Good | Good | Good |
| Generated current (μA) | 20.8 | 26.3 | 32.3 | — |
| Foam cell uniformity | Good | Good | Good | Poor |
| Torque (kgf · cm) | 0.54 | 0.83 | 1.20 | 1.32 |

TABLE 5

| | Roller F | Roller F1 | Roller F2 |
|---|---|---|---|
| Outer diameter (mm) | 15.5 | 14.7 | 14.5 |
| Torque (kgf · cm) | 0.54 | 0.38 | 0.25 |
| Toner scraping off capability (ghost image evaluation) | Good | Good | Poor |

In an experiment, during a manufacturing process of the rollers F to I, as shown in Table 4, the polyol, the isocyanate, the forming agent, the catalyst, and the foaming control agent were mixed and poured in the square container having a side length of 500 mm. Without placing a lid on the square container, the mixture was foamed under atmospheric pressure. Then, the square container was passed through a heating oven to heat the mixture, so that the mixture was reacted and cured, thereby obtaining the foamed member having the continuous foam cells.

In the second embodiment, as described above, carbon black, instead of the ion conductive agent used in the first embodiment, was added to the core metal 16A of the toner supplying roller 16. In the experiment, ketjen black EC600JD (a product of Lion Corporation) was used as carbon black. After the foamed member was produced, the manufacturing process was similar to that explained above with reference to Tables 1 to 3.

With regard to the roller F, as shown in Table 5, the outer diameter of the roller F was 15.5 mm. Further, the roller F was polished, so that the outer diameters of the roller F1 and the roller F2 became 14.7 mm and 14.5 mm. Accordingly, only the outer diameters of the rollers F1 and F2 were different from that of the roller F.

In Table 4, the volume resistivity ρ is represented in a format of $10^{\rho}$ (Ω·cm) in a case that the voltage of 10 V was applied each of the rollers G to I. In a case of the roller F, due to an extremely high resistivity, a voltage of 500 V was applied, so that the resistivity did not exceed the dynamic range of the measurement device.

A method of evaluating a uniformity of the foam cells shown in Table 4 will be explained next. The uniformity of the foam cells was evaluated from sizes of foam cells formed on a straight line of 25 mm at an arbitrary position on the surface of the elastic foamed layer 16B of the toner supplying roller 16.

When the sizes of the foam cells were in a range of 200 μm to 600 μm, the toner supply capability of the toner supplying roller 16 to the developing roller 17 and the toner scraping off capability of the developing blade 18 relative to the developing roller 17 were most desirable, thereby obtaining the good image quality of the image data developed on the recording medium 21. When the sizes of the foam cells were smaller than 200 μm or greater than 600 μm, the toner supply capability and the toner scraping off capability were not desirable, thereby obtaining the poor image quality of the image data developed on the recording medium 21. Accordingly, in Table 4, when the sizes of the foam cells were in a range of 200 μm to 600 μm, the result was represented as good, and when the sizes of the foam cells were smaller than 200 μm or greater than 600 μm, the result was represented as poor.

With respect to the rollers F to I, the blurred text did not occur at the accumulated printed sheets of 10,000. Further, at the accumulated printed sheets of 10,000, the toner 14 was squeezed and filled in the elastic foamed layer 16B of the toner supplying roller 16. In this state, as shown in Table 4, the rollers F to H showed the generated currents of 20.8 μA, 26.3 μA, and 32.3 μA, respectively. When the generated current was greater than 10.0 μA at the applied voltage of less than 100 V, the blurred text did not occur.

In the experiment, as described above, the roller A had the volume resistivity ρ of the foamed member at the very high value, i.e., $10^{12.3}$ Ω·cm, before the carbon fixing process. The rollers F to H had the volume resistivity ρ of the foamed member at the same value, i.e., in a range of $10^{9.1}$ to $10^{12.1}$ Ω·cm, before the carbon fixing process. Accordingly, when the ion conductive agent was not added such as in the case of the roller A, it was possible to realize only the low conductivity. On the other hand, when carbon black was added such as in the case of the rollers F to H, it was possible to realize the high conductivity. In this case, the conductive path was not limited to the foam cell walls of the core metal 16A, where the carbon fixing agent was adhered, but rather included in the resin portion of the foamed member. Accordingly, the electron conductive mechanism involved in the carbon fixing process and the electron conductive mechanism in the urethane backbones were mutually contributed to the volume resistivity.

In the experiment, with respect to the roller I, carbon black inhibited foaming of the foamed member, thereby causing a foaming problem. More specifically, the toner 14 adhered to the surface of the developing roller 17 during the endurance test of the accumulated sheets of 10,000, thereby causing a drum filming. The roller E contained the relatively large amount of carbon black at 8.0 wt %.

Note that FIG. 11 does not show the measurement data of the roller I. Further, the rollers F to H and the roller F1 showed the good toner scraping off property using the ghost image evaluation method. On the other hand, the roller F2 showed the poor toner scraping off property using the ghost image evaluation method. This was attributed to the fact that the roller F2 showed the low torque of 0.25 kgf·cm as compared with the other rollers.

As described above, in the embodiment, the toner supplying roller 16 is formed of the foamed member with the continuous foam cells have the high electrical resistivity of the electrical conductivity due to the ion conductivity. Further, after carbon black is fixed to the foam cell walls, the toner supplying roller 16 has the low resistivity of the electrical conductivity. Accordingly, when the image forming apparatus 1 prints a large number of print sheets, it is possible to prevent the blurred text and the lowered text density of the image developed on the recording medium 21.

In the first and second embodiments described above, the image forming apparatus 1 is explained as the printer, and may be provided in a copier, a facsimile, and a MFP (Multi Function Product). Further, the developing device 2 includes the four developing devices 2C, 2M, 2Y, and 2K corresponding to cyan, magenta, yellow, and black, and may include three developing devices 2C, 2M, and 2Y corresponding to cyan, magenta, and yellow without black. Similarly, the developing device 2 includes two developing devices 2K for developing the image information corresponding to black. As described above, the number of the developing device 2 or the combination of colors of the developing device 2 is not limited to that in the embodiments, and may be modified within a scope of the invention.

The disclosure of Japanese Patent Application No. 2009-180088, filed on Jul. 31, 2009, is incorporated in the application.

While the invention has been explained with reference to the specific embodiments of the invention, the explanation is illustrative and the invention is limited only by the appended claims.

What is claimed is:

1. A developer supplying member comprising:

a foamed member for supplying developer to a developer supporting member;

an ion conductive agent for imparting conductivity to the foamed member through ion conductivity; and a carbon black attached to foam cell walls of the foamed member, wherein said developer supplying member is configured to generate an electric current greater that 10.0 μA when a voltage of 100 V is applied to the developer supplying member after 10,000 sheets are printed.

2. The developer supplying member according to claim 1, wherein said foamed member is formed of a urethane resin.

3. The developer supplying member according to claim 2, wherein said ion conductive agent is contained in the mixture in a range of 0.1 wt % and 4.0 wt %.

4. The developer supplying member according to claim 1, wherein said foamed member is formed through foaming a mixture of a polyol, an isocyanate, a foaming agent, a catalyst, a foaming control agent, and the ion conductive agent, heating and curing the mixture, immersing the mixture thus cured in a carbon black conductive processing solution, and heating and drying the mixture thus immersed.

5. The developer supplying member according to claim 1, wherein said foamed member has the high electrical resistivity through the ion conductivity in a range of $10^{10.1}$ (Ω·cm) and $10^{11.9}$ (Ω·cm).

6. The developer supplying member according to claim 1, wherein said foamed member has the low electrical resistivity less than $10^{5.9}$ (Ω·cm) after the carbon black is attached to the foam cell walls thereof.

7. A developing device comprising the developer supplying member according to claim 1.

8. An image forming apparatus comprising the developing device according to claim 7.

9. The developer supplying member according to claim 1, wherein said developer supplying member generates the electric current between 32.6 μA and 48.3 μA when the voltage of 100 V is applied to the developer supplying member after 10,000 sheets are printed.

10. The developer supplying member according to claim 1, wherein said foamed member is formed of continuous foams.

11. A developer supplying member comprising:

a foamed member for supplying developer to a developer supporting member;

an electron conductive agent for imparting conductivity to the foamed member through electron conductivity; and a first carbon black attached to foam cell walls of the foamed member, wherein said developer supplying member is configured to generate an electric current greater than 10.0 μA when a voltage of 100 V is applied to the developer supplying member after 10,000 sheets are printed.

12. The developer supplying member according to claim 11, wherein said foamed member is formed of a urethane resin.

13. The developer supplying member according to claim 11, wherein said foamed member is formed through foaming a mixture of a polyol, an isocyanate, a foaming agent, a catalyst, a foaming control agent, and a second carbon black as the electron conductive agent, heating and curing the mixture, immersing the mixture thus cured in a carbon black conductive processing solution, and heating and drying the mixture thus immersed.

14. The developer supplying member according to claim 13, wherein said second carbon black is contained in the mixture in a range of 0.1 wt % and 5.0 wt % before the first carbon black is attached to the foam cell walls thereof.

15. The developer supplying member according to claim 11, wherein said foamed member has the high electrical resistivity through the electron conductivity in a range of $10^{10.1}$ (Ω·cm) and $10^{12.1}$ (Ω·cm).

16. The developer supplying member according to claim 11, wherein said foamed member has the low electrical resistivity less than $10^{6.1}$ (Ω·cm) after the first carbon black is attached to the foam cell walls thereof.

17. A developing device comprising the developer supplying member according to claim 11.

18. An image forming apparatus comprising the developing device according to claim 17.

19. The developer supplying member according to claim 11, wherein said developer supplying member generates the electric current between 20.8 μA and 32.3 μA when the voltage of 100 V is applied to the developer supplying member after 10,000 sheets are printed.

20. The developer supplying member according to claim 11, wherein said foamed member is formed of continuous foams.

* * * * *